United States Patent [19]

Baumann

[11] Patent Number: 4,581,788

[45] Date of Patent: Apr. 15, 1986

[54] TELESCOPING CURTAIN ROD INCLUDING RUNNERS

[75] Inventor: Heinz Baumann, Zurich, Switzerland

[73] Assignee: Spirella AG, Switzerland

[21] Appl. No.: 561,918

[22] Filed: Dec. 15, 1983

[30] Foreign Application Priority Data

Oct. 24, 1983 [CH] Switzerland ..... 5760/83

[51] Int. Cl.[4] ..... A47H 15/00

[52] U.S. Cl. ..... 16/93 D; 16/94 D; 16/96 D

[58] Field of Search ..... 16/93 R, 93 D, 94 D, 16/95 D, 96 D, 95 DW, 87.4 R, 87.4 W, 87.6 R, 87 R, 87.2, 90, 91, 94 R, 95 R; 160/330, 123–126

[56] References Cited

U.S. PATENT DOCUMENTS 2,683,890 7/1954 Rosenbaum ..... 16/93 D 2,683,891 7/1954 Rosenbaum ..... 16/93 D 3,230,308 5/1943 Silverman ..... 16/93 D

*Primary Examiner*—Donald R. Schran

*Assistant Examiner*—James Wolfe

*Attorney, Agent, or Firm*—Diller, Ramik & Wight

[57] ABSTRACT

The curtain rod acts as shield concealing the runners and the upper edge of the curtain. The runners are guided by edges of slots in the inner and outer rod sections by means of grooves. The grooves receive the slot edges of the inner as well as outer rod section of the telescoping curtain rod only at the area of transition between inner and outer rod section. The runners glide back and forth between the outer rod section and the inner rod section without impinging at any place. This is due to the design according to which mentioned edges of the slots cooperate exclusively with only one each of two grooves present in the runners, each groove alocated to one respective guiding edge.

5 Claims, 4 Drawing Figures

TELESCOPING CURTAIN ROD INCLUDING RUNNERS

BACKGROUND OF THE INVENTION

1. Field of the Invention

The present invention relates to a telescoping curtain rod including two longitudinally displacable and arrestable rod sections extending within each other and having guide means for its runners intended for supporting a curtain and shiftable along the curtain rod within a slot.

Telescoping curtain rods are generally used in bathrooms.

2. Description of the Prior Art

The curtains of telescoping curtain rods used primarily in bathrooms are generally supported by rings guided by means of the rod and extending around such rod.

The appearance of such a curtain rod including annular, ring-shaped runners is often times unsatisfactory because expensive and aesthetically appealing curtains must be combined with the conventional supporting structures which have often a cheap appearance.

In order to avoid having to use rings of a rather clumsy appearance runners could be made use of which are guided in a slot extending at the bottom side of the curtain rod, however such design would lead to the difficulty of the runners striking or impinging the step at the transition between inner and outer rod section of the telescoping curtain rod. Such leads to a troublesome opening or closing of the curtain. Furthermore, such runners would still be visible as such.

SUMMARY OF THE INVENTION

It is, therefore, a general object of the invention to provide a telescoping curtain rod and runners in which the runners can slide smoothly over the transition area between the inner and the other curtain rod and in which the runners are concealed.

A further object is to provide a telescoping curtain rod having a slot in which the runners are received which extends at the side of the curtain rod in its mounted position.

Accordingly, the curtain rod itself acts as a screen or shield respectively, concealing the runners and the upper edge of the curtain.

In order to provide an inpeccable shifting movement of the runners the edges of the slots of the outer and inner rod section extend parallel at a mutual distance from each other such to form the guide means for the runners.

Each runner comprises preferably two guide grooves each of which cooperating with the guide means of one only of the two rod sections and comprises further a plurality of elastically bending locking tongues projecting laterally from the runner body and having enlarged sections at their outer ends. The runners are guided by the outer rod section only in a first groove located directly adjacent of the locking tongues, at the transition area between inner rod section and outer rod section the guide means of the inner rod section are received additionally in a second groove. If the runner is displaced further from mentioned transition area towards the inner rod section such runner will be supported only by the guide means of the inner rod section engaging into its second groove.

BRIEF DESCRIPTION OF THE DRAWINGS

The present invention will be more fully understood by reference to the following detailed description thereof, when read in conjunction with the attached drawings, and wherein.

DESCRIPTION OF THE PREFERRED EMBODIMENT

Figure 1:
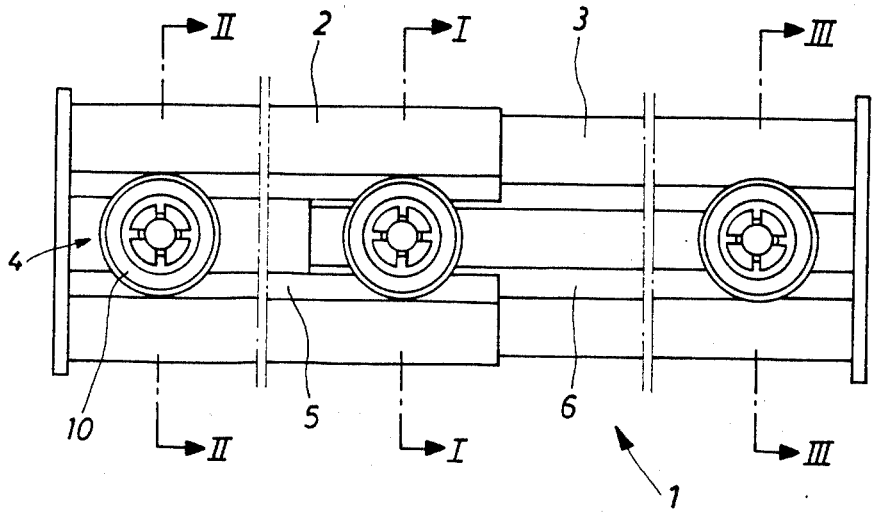
FIG. 1 is a schematic side view of a telescoping curtain rod including runners.

Referring now to the drawings and considering initially the schematic illustration of FIG. 1 it will be understood that the telescoping curtain rod 1 comprises an outer rod section 2 and an inner rod section 3. The rod sections are locked against a shifting relative to each other by conventional structures which are not particularly shown for sake of clearness. FIG. 1 illustrates further three runners 10 intended to mount a curtain 13.

Figure 2:
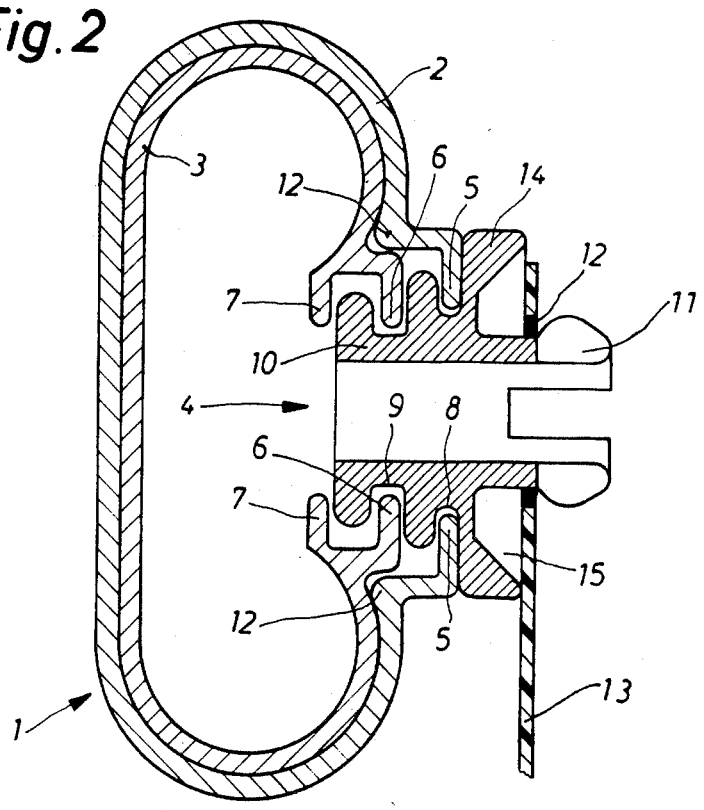
FIG. 2 is a view of the section along line I—I of FIG. 1.
Figure 3:
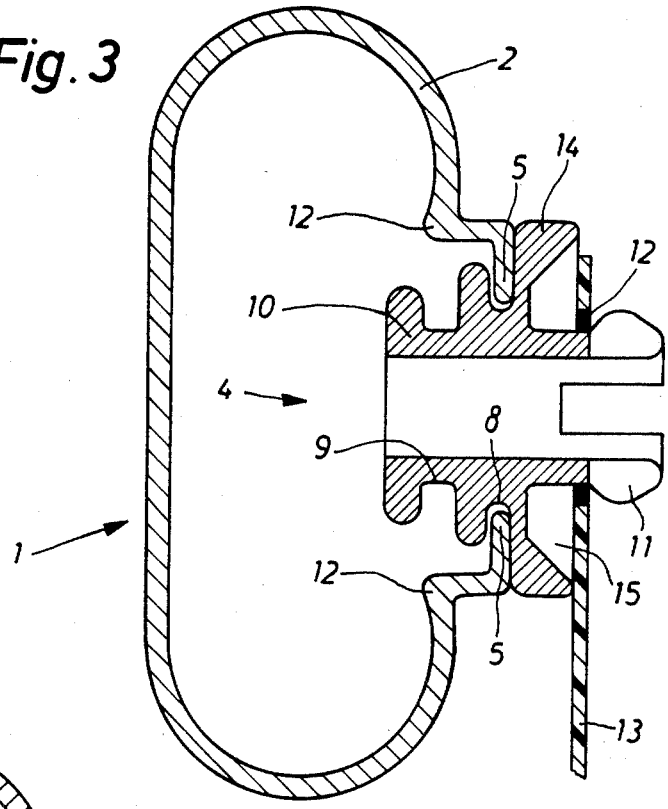
FIG. 3 is a view of the section along line II—II of FIG. 1.
Figure 4:
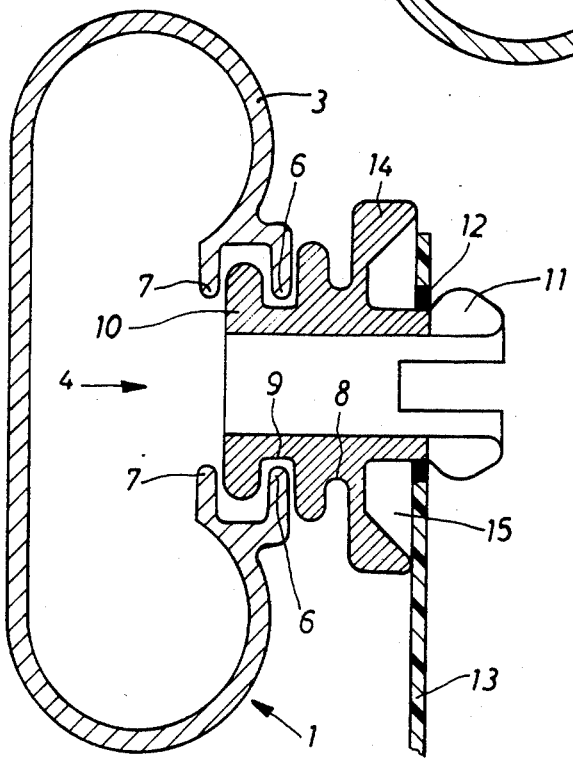
FIG. 4 is a view of the section along line III—III of FIG. 1.

FIG. 2 is a view of the section along line I—I extending through the area of transition between the inner rod section 3 and the outer rod section 2 designed in FIG. 1. The edge zones or edge portions 5 of the outer rod section 2 limiting its slot 4 are received in a first guide groove 8 of runner 10. Edge zones or edge portions 6,7 limiting the slot (unnumbered) of the inner rod section 3 encase the end section of the runner 10 ending at a second guide groove 9.

If a large pulling force is applied onto the curtain it is possible that rather high forces will act upon the runners and accordingly upon the edges zones or edge portions 5, 6 and 7 of the respecitve rod section 2, 3 limiting slot 4.

It is, furthermore, necessary to design the guide grooves 8,9 of the runners 10 such to have a rather large width. An impeccable gliding of the runners along the rods may otherwise be arrived at only if strict manufacturing tolerances are obeyed and/or if the curtain rod will not be elastically flexed in operation. Furthermore, the inner rod section 3 will tilt somewhat in the outer rod section 2 specifically when the curtain rod is extended to its longest extent. In such case it is specifically important that the edges or edge portions 5, 6, 7 of the slots do not deform. This is arrived at by the in cross section forked edge areas of the inner rod section 3 which edge areas comprise edge zones 6 and 7.

Such a design is, furthermore, advantageous in that the end portion of the runners 10 limited by the second guide groove 9 is tightly encased. The runners 10 tilt hardly in spite of the rather large width of their grooves although a substantially large pitching torque is present due to a support of the runners 10 at their outer ends in comparison with their support at the outer rod section 2 such as can be easily seen because the distance of the inner guide groove 9 from the curtain 13 is roughly double the distance of the outer guide groove 8 from curtain 13. Accordingly, the runners 10 will hardly tilt to such an extent that an impinging on the edges of the slots at the transition between inner and outer rod section is possible. Such as already mentioned above, the runners 10 are designed as short as possible in order to avoid to large tilting torques.

This is made possible because the edge zones 6 of the inner rod section 3 lie on top of the shoulder 12 shaped by a bending of the edge areas of the outer rod section 2. Accordingly, the second guide groove 9 of the runner 10 must have a somewhat larger depth then the first guide groove 8 to allow a sufficient height of the edge zones 6. Furthermore, the runner portion comprising the grooves 8,9 extends conically or, in case it is not designed axially symmetrical, is given a wedge-shaped longitudinal cross section. This will allow a support at the outer side of the edge zones 5 over a rather large area.

The innermost edge or edge portion 7 is not necessary if the curtain rod 1 is subject to smaller, limited stresses.

The curtain 13 is mounted to the runners 10 in that reinforcing rings 12 located in the curtain during its manufacture are pressed over the elastically yielding tongues 11 of the runners 10.

A dish-shaped recessed area 15 is arranged in the outer flange portion 14 of each runner 10 which recessed area 15 causes the curtain 13 to arch, that is the curtain 13 will be prefolded at the locations corresponding to the runners 10. In other words, the tongues 11 form, together with the recessed area 15 in the flange 14, an aid for folding the suspended curtain.

While there is shown and described a present preferred embodiment of the invention, it is to be distinctly understood that the invention is not limited thereto, but may be otherwise variously embodied and practiced within the scope of the following claims. Accordingly,

I claim:

1. A telescopic curtain rod comprising two longitudinally displaceable rod sections including an inner rod section telescopically received in an outer rod section, each rod section having a slot, a plurality of runners adapted to support a curtain, said runners being mounted for sliding movement along an associated one or both of said slots, guide portions along each of said inner and outer rod sections, the inner telescopic rod section guide portion being defined by two pairs of spaced opposing edge portions formed by a forked edge of said inner telescopic rod section, each of said runners having a runner body including guide means for simultaneously guidingly engaging said guide portions of both said inner and outer rod sections and for separately guidingly engaging said guide portions of only individual ones of said inner and outer rod sections, said guide means including two guide grooves in each runner body, each of said guide grooves receives a respective one of said rod section guide portions, said two guide grooves include an inner guide groove and an outer guide groove receiving the guide portions of said respective inner and outer rod sections, and the depth of said inner guide groove being greater than the depth of said outer guide groove.

2. The telescopic curtain rod as defined in claim 1 wherein each runner body includes a recess opening concavely toward but spaced from an associated enlarged head.

3. The telescopic curtain rod as defined in claim 1 wherein each runner body is generally axially symmetrical.

4. The telescopic curtain rod as defined in claim 1 including means carried by each runner for mounting a curtain thereon, said curtain mounting means being each defined by axially projecting locking tongues of each runner body terminating in an enlarged head.

5. The telescopic curtain rod as defined in claim 4 wherein each runner body includes a recess opening concavely toward but spaced from an associated enlarged head.

* * * * *